United States Patent [19]

Davenport

[11] Patent Number: 5,005,610

[45] Date of Patent: Apr. 9, 1991

[54] PAPERMAKING FABRIC PIN SEAM WITH BRAIDED YARNS IN JOINING LOOPS

[75] Inventor: Francis L. Davenport, Ballston Lake, N.Y.

[73] Assignee: Albany International Corporation, Albany, N.Y.

[21] Appl. No.: 293,207

[22] Filed: Jan. 3, 1989

[51] Int. Cl.[5] ..... D03D 13/00; D03D 15/00

[52] U.S. Cl. ..... 139/383 AA; 428/280; 428/222; 139/420 R

[58] Field of Search ..... 139/383 AA, 420 R; 24/33 D, 33 C; 162/DIG. 1, 358; 428/232, 280, 222; 28/141

[56] References Cited

U.S. PATENT DOCUMENTS

| | | | |
|---|---|---|---|
| 4,006,760 | 2/1977 | Romanski et al. | 139/383 A |
| 4,103,717 | 8/1978 | Clark | 139/383 A |
| 4,186,780 | 2/1980 | Josef et al. | 139/383 A |
| 4,791,708 | 12/1988 | Smolens | 24/33 C |

*Primary Examiner*—Andrew M. Falik

*Attorney, Agent, or Firm*—Kane, Dalsimer, Sullivan, Kurucz, Levy, Eisele and Richard

[57] ABSTRACT

A pin-seamable papermaker's fabric, designed for use on the press section of a papermachine, is woven from systems of yarns which align in the machine and cross-machine directions of the papermachine when the fabric is operating thereon. The machine-direction yarns have a composite structure, including braided monofilament strands as the load-bearing components of the fabric. The fabric is produced in open-ended form, and has loops at each end formed by the machine-direction yarns. It is made endless during installation on the papermachine by bringing the two ends together, by interdigitating the loops of the two ends, and by directing a pin, or pintle, through the passage formed by the interdigitated loops. The loops themselves, being formed by the machine-direction yarns, likewise include braided monofilament strands.

2 Claims, 3 Drawing Sheets

PAPERMAKING FABRIC PIN SEAM WITH BRAIDED YARNS IN JOINING LOOPS

BACKGROUND OF THE INVENTION

1. Field of the Invention

This invention relates to the press fabrics used in the press section of papermaking machines to support, carry, and dewater the wet fibrous sheet as it is being processed into paper. It more specifically relates to open-ended fabrics whose ends are joined by means of a pin seam when being installed on the machine. The invention further relates to the use of a braided yarn for the machine direction (MD) strands of the press fabric.

2. Background Information

Endless fabrics are key components of the machines used to manufacture paper products. Of immediate concern here are the fabrics used in the press section. Not only does the press fabric act as a type of conveyor belt carrying the wet fibrous sheet being processed into paper through the section, but, more importantly, it also accepts water that is mechanically pressed from the sheet as it passes through the press. More specifically, the press squeezes water from the sheet into the fabric.

Until fairly recently, the press fabrics used in the press section were supplied in endless form; that is, they were woven in the form of an endless loop without a seam. This was partly because of the limitations of seam and weaving technology. In addition, however, the press section poses additional special considerations not present in the other sections of the papermaking machine.

Historically, most of the methods of joining the ends of an open fabric involve a seam which is much thicker than the rest of the body of the fabric. This can cause major problems on a fabric used in the press section. The thicker seam will be subjected to higher compressive forces on each passage through the press nip weakening the seam and thus shortening fabric life. In addition, potentially damaging vibrations can be set up in the press machinery by the repetitive passages of the thicker seam region. Finally, the wet fibrous sheet, still quite fragile in the press section because of its high water content, can be marked, if not broken, by extra compression at the seam location.

Despite these considerable obstacles, it remained highly desirable to develop an on-machine-seamed (OMS) press fabric, because of the comparative ease and safety with which it can be installed on the machine. This simply involves pulling one end of the open-ended press fabric through the machine, around the various guide and tension rolls and other components. Then, the two ends can be joined at a convenient location on the machine and the tension adjusted to make the fabric taut. In fact, a new fabric is usually installed at the same time as an old one is removed. In such a case, one end of the new fabric is connected to an end of the old fabric, which is used to pull the new fabric into its proper position on the machine.

By way of contrast, the installation of an endless fabric on a press section is a difficult and time-consuming undertaking. The machine must be shut down for a comparatively longer period while the old fabric is cut out or otherwise removed. The new fabric then must be slipped into proper position from the side into the gaps between the presses through the frame and around other machine components. The difficulty of this procedure is further compounded by the fact that the newer

- generation press fabrics are gradually becoming thicker and stiffer. These characteristics add to the time and effort required on the part of plant personnel to install a new one. In this connection, a workable OMS press fabric was an advance long sought by the industry.

One method of joining the ends of an open-ended fabric together is by using a pin seam, so called because its integral element is a pin, or pintle, which joins together the loops at the ends of the press fabric.

One method to produce an open-ended fabric, that can be joined on the paper machine with a pin seam, is to weave the fabric in such a way that the ends of the machine direction (MD) strands can be turned back and woven into the body of the fabric and parallel to the machine direction. The second technique employs the art of weaving "endless", which normally results in a continuous loop of fabric. However, when making a pin-seamable press fabric, one edge of the fabric is woven in such a way that the body yarns form loops, one set of alternating loops for each end of the woven cloth.

The ends of the fabric are joined by bringing them into close proximity with each other, intermeshing and alternating the loops on each end of the fabric. The pintle is then passed through the voided space running down the centers of the intersecting loops to complete the seam. The region of the seam is only slightly thicker than the main body of the fabric belt, because the loops formed use the MD body yarn strands.

The present invention concerns the problems with the loops themselves. The MD yarn in a conventionally woven press fabric structure, flat or endless, has not previously had the added requirements of loop formation and integrity.

Single monofilament was originally used in the machine direction for OMS press fabrics since it was stiff and has good loop formation properties. But experience showed it not only to be difficult to weave but also to have insufficient MD elasticity for many kinds of contemporary presses. As a consequence, tensile failure and seam breakage have been problems.

Standard textile ply/twisted monofilament has been used in the machine direction in an attempt to solve these problems. In the weaving process, it has proved to be much easier to use than single monofilament. Its improved elasticity and strength answer the tensile and fatigue problems of single monofilament. However, when one attempts to form the loops for a pin seam from these MD yarns, serious problems are encountered. The loops so formed have the tendency to deform at the apex. In addition, the entire loop will rather easily deform or bend as one attempts to force a pintle through the loop opening.

Another problem arises as a result of a phenomenon called the secondary helix effect. It will be recalled that ideally the pin seam loops will be properly oriented when their planes are perpendicular to the plane of the fabric and parallel to the machine direction. Such an orientation makes it possible for the loops at each end of the fabric to be intermeshed and alternated easily during the joining of the ends to form a pin seam. The secondary helix effect is observed in the tendency of a loop formed from a twisted yarn to turn about an axis lying in the plane of the loop. When this occurs, it represents a departure of the loop from the ideal orientation needed to form the pin seam. Such departure makes it difficult, if not impossible, to properly intermesh and alternate the loops on each end of the press fabric during closure, as well as to force the pintle through the void created by the intermeshed loops.

This invention represents a means to overcome this difficulty. The OMS loops formed as instructed here will have the tensile strength and fatigue resistance of twisted monofilament, yet will not exhibit the twisting behavior illustrative of the secondary helix effect.

SUMMARY OF THE INVENTION

This invention overcomes the shortcoming represented by the tendency of the OMS loops formed by ply/twisted MD yarn to be susceptible to the secondary helix effect. It also overcomes the tendency for the plies to separate at the yarn apex which prevents easy loop meshing. It consists of the use of a composite yarn comprising braided monofilaments in the machine direction, rather than one which is single or ply/twisted. To its advantage, such a yarn has greater elasticity and tensile strength in the machine direction as well as the ability to form a pin seam loop of improved strength.

A composite yarn which includes braided monofilament is better able to maintain its integrity than one of twisted monofilament, and will permit good loop formation. The loops so formed will readily mesh to create the path required by the pintle which closes the seam. Unlike a twisted yarn, one that has been braided will be balanced, so that the secondary helix effect will not arise. Of additional advantage, these yarns will form a stiffer loop which will not be easily deflected or deformed by other loops or the pintle.

The yarns of the present invention will have the MD extensibility of a ply/twisted yarn, and, according to available evidence, will have better resistance to fatigue.

In addition, test results indicate that these yarns maintain their shape under load better than a ply/twisted yarn. In this respect, it behaves more like a single monofilament than a ply/twisted one when under compressive load by not being easily flattened. As a result, press fabric caliper and void volume will be better maintained under load with the use of the braided yarn.

Further embodiments of the composite yarns of this invention comprise monofilament or multifilament or (BCF) cores surrounded by the braided monofilaments, as well as multifilament or bulk continuous filament (BCF) wrappers.

Features common to more than one figure have been given the same identifying numerals in each.

DESCRIPTION OF THE PREFERRED EMBODIMENT

Figure 1:
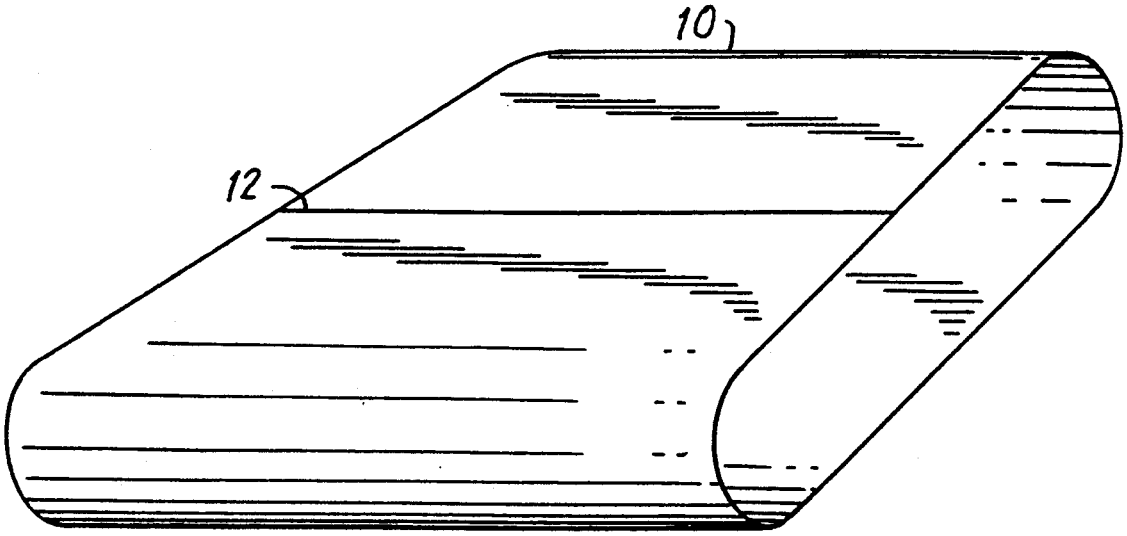
FIG. 1 is a plan view of a seamed press fabric to which the present, invention is directed.

With reference now to the figures, a schematic view of a press fabric 10 joined into endless form by means of a seam 12 is shown in FIG. 1. The seam 12 is closed by bringing the OMS loops at each end of the open press fabric 10 into close proximity with each other and, more specifically, intermeshing and alternating those at each end. The task is completed by passing a pintle down through the space defined by the intermeshed loops.

Figure 2:
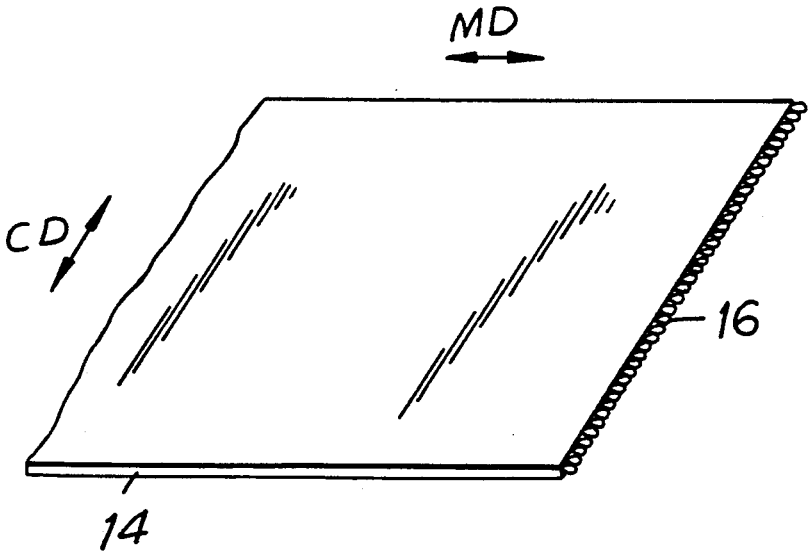
FIG. 2 is a perspective view of one end of an open-ended press fabric designed to be closed during installation on a press section of a papermachine by means of a pin seam. OMS loops can be seen along the right edge of the press fabric.

The preferred mode of practicing this invention comprises weaving a press fabric using composite strands of yarn in the machine direction. The important characteristics, for the purposes of the invention, of the composite yarns is that they comprise braided strands of monofilament. FIG. 2 represents one end 14 of an open-ended, as yet unseamed press fabric 10. The on-machine-seamed (OMS) loops 16 are formed either by weaving the ends of the braided machine direction (MD) strands back into the body of the press fabric 10 or by weaving the press fabric 10 in accordance with a modified endless weaving technique. In FIG. 2, machine direction and cross-machine direction are represented by MD and CD respectively.

Figure 3A:
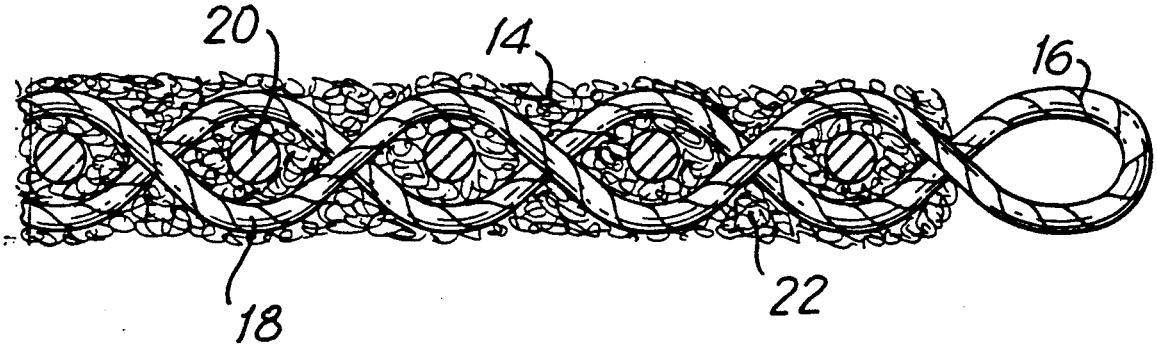
FIG. 3*a* is a cross-sectional view of the press fabric showing the formation of an OMS loop by the flat-woven technique.
Figure 3B:
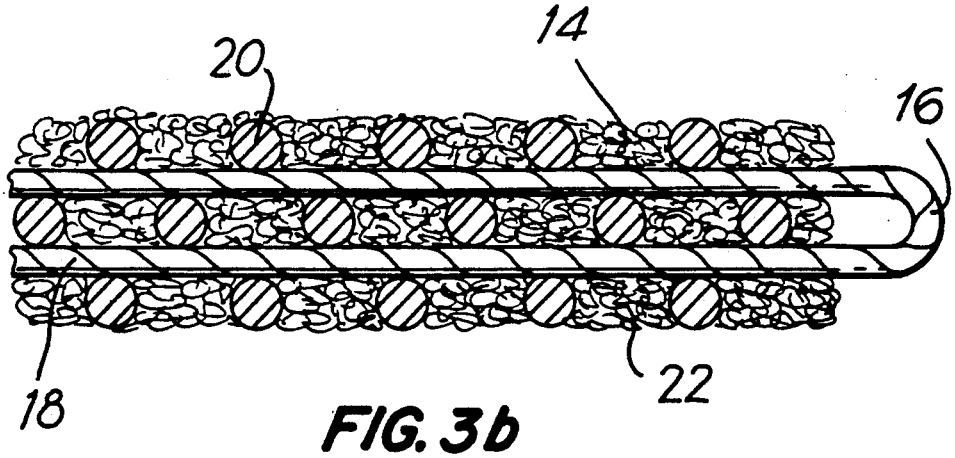
FIG. 3*b* is the corresponding view for a press fabric woven by a modified endless weaving procedure.

FIGS. 3*a* and 3*b* are enlarged, cross-sectional views of the end 14 of the press fabric 10 showing the formation of the loops 16 in FIG. 2. In both FIGS. 3*a* and 3*b*, the loops 16 are formed from the MD yarns 18, which can clearly be seen to be the composite yarns according to the design of the present invention. The CD yarns 20 are drawn in cross section as monofilaments merely for the sake of convenience; yarns of other types can be used in the cross-machine direction. A fibrous batt 22 is shown needled into the woven structure of both figures.

FIGS. 3*a* and 3*b* differ from each other chiefly because of the way in which the loops 16 in each were formed. In FIG. 3*a*, the loop 16 has been formed by weaving the MD strand 18 back into the body of the press fabric 10. This procedure is required if the fabric has been flat woven. In FIG. 3*b*, on the other hand, the press fabric 10 has been woven in modified endless fashion. In this technique, the MD strands 18 simply weave back and forth, as they are the weft yarns in this mode of weaving, forming loops 16 at each end of the press fabric.

FIGS. 4*a* through 4*e* depict five different embodiments of the MD composite yarns 18 of the present invention in cross section. Characteristic of each embodiment is a braided yarn of a number, typically eight, monofilament strands 20. These monofilament strands 20 have individual diameters falling in the range from 0.003 inches to 0.012 inches (3 mils to 12 mils). Finer or thicker monofilaments could be used depending upon need; for example, coarser monofilaments would be quite acceptable for fabrics used on paper machines producing heavier paper grades.

Figure 4A:
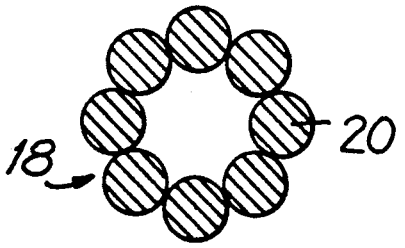
FIGS. 4*a* through 4*e* show cross-sectional views of the MD yarns, used in the formation of the OMS loops, of the present invention.

In FIG. 4*a*, a cross-sectional view of a braided monofilament is shown. This composite yarn 18 in this case consists of eight strands, or "ends", of monofilament 20 forming what could well be described as a hollow, porous tube.

Figure 4D:
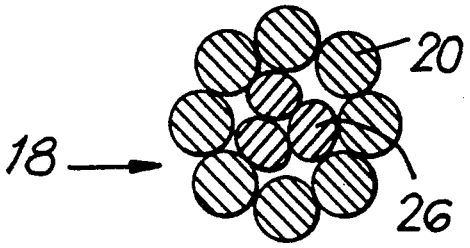
Figure 4B:
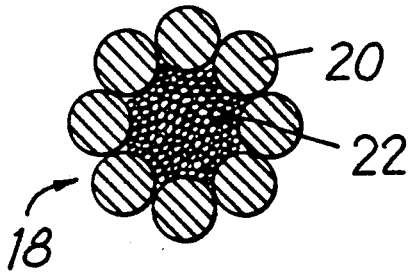

FIG. 4*b* shows another embodiment of the present machine direction yarn 18 in which the monofilament strands 20 surround a core of multifilament 22. FIG. 4*b* could equally represent the cases where the multifilament 22 was a spun yarn, or was substituted with bulk-continuous filament (BCF). BCF consists of continuous strands of filament that are neither twisted nor spun together. Rather, kinks in the strands of filament provide the means by which the strands in the BCF are held together.

Figure 4E:
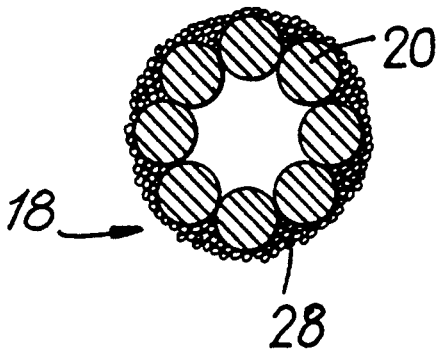
Figure 4C:
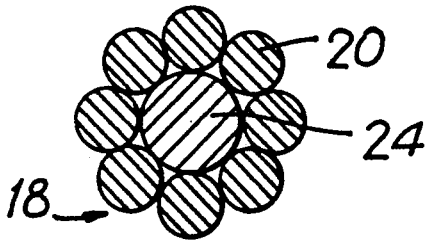

FIG. 4c shows a cross-section of an MD composite yarn 18 comprising monofilament strands 20 braided around a monofilament core 24. Similarly, FIG. 4d shows an MD composite yarn 18 wherein the monofilament strands 20 are braided around a core of plied monofilament 26.

FIG. 4e shows still another embodiment of the MD composite yarn 18 of the present invention. Here the strand of braided monofilament 20 is surrounded by a multifilament wrapper 28.

As implied by these figures, the present invention embraces a wide variety of yarns for use in forming OMS loops with MD strands, of which those noted in the following table are but examples:

| Type | Diameter (mil) | Diameter (mm) |
|---|---|---|
| 8 end braid | 36 | .91 |
| braid/2 × 3 ply core | 55 | 1.4 |
| braid/spun yarn core | 39 | .99 |
| braid/spun yarn core | 46 | 1.1 |
| braid/BCF yarn core | 48 | 1.2 |
| braid/BCF yarn & 16 mil mono core | 48 | 1.2 |
| braid/spun yarn & 16 mil mono core | 52 | 1.3 |

Modifications to the above would be obvious to one skilled in the art without departing from the scope of the invention as defined in the appended claims.

What is claimed is:

1. An open-ended press fabric, for use on the press section of a papermaking machine, and designed for pin-seam closure, comprising:

a system of machine direction (MD) yarns and a system of cross-machine direction (CD) yarns, said yarns of said system of machine-direction (MD) yarns being interwoven with said yarns of said system of cross-machine direction (CD) yarns to form said open-ended press fabric in a rectangular shape with a length, a width, two lengthwise edges, and two widthwise edges, said machine-direction (MD) yarns extending for said length of said open-ended press fabric between said two widthwise edges, said machine-direction (MD) yarns further forming loops along each of said two widthwise edges for joining said two widthwise edges to one another with a pin seam, said pin seam being integral to said open-ended press fabric, said machine direction (MD) yarns extending for the length of said open-ended press fabric being braided yarns formed by braiding a plurality of monofilament strands together, said braided yarns forming said loops so that said loops may maintain a preselected orientation along said two widthwise edges of said open-ended press fabric to facilitate the intermeshing of said lops when said two widthwise edges are brought together to form said pin seam.

2. An open-ended press fabric as claimed in claim 1 wherein said plurality of monofilament strands comprised in said braided yarns, said braided yarns being said machine direction (MD) yarns of said open-ended press fabric, are braided to form porous tubes, said porous tubes having central cores.

* * * * *

UNITED STATES PATENT AND TRADEMARK OFFICE

CERTIFICATE OF CORRECTION

PATENT NO. : 5,005,610

DATED : April 9, 1991

INVENTOR(S) : Francis L. Davenport

It is certified that error appears in the above-identified patent and that said Letters Patent is hereby corrected as shown below:

Column 6, after line 34 please insert the following claims:

3. An open-ended press fabric as claimed in claim 2, wherein said braided yarns, said braided yarns being said machine direction (MD) yarns, further comprise a multifilament yarn, said multifilament yarn being within said central core of said braided yarn.

4. An open-ended press fabric as claimed in claim 2, wherein said braided yarns, said braided yarns being said machine direction (MD) yarns, further comprise bulk-continuous filament (BCF) strands, said BCF strands being within said central core of said braided yarn.

5. An open-ended press fabric as claimed in claim 2, wherein said braided yarns, said braided yarns being said machine direction (MD) yarns, further comprise a multifilament wrapper.

6. An open-ended press fabric as claimed in claim 2, wherein said braided yarns, said braided yarns being said machine direction (MD) yarns, further comprise a spun yarn, said spun yarn being within said central core of said braided yarn.

UNITED STATES PATENT AND TRADEMARK OFFICE

CERTIFICATE OF CORRECTION

PATENT NO. : 5,005,610

DATED : April 9, 1991

INVENTOR(S) : Francis L. Davenport

It is certified that error appears in the above-identified patent and that said Letters Patent is hereby corrected as shown below:

7. An open-ended press fabric as claimed in claim 2, wherein said braided yarns, said braided yarns being said machine direction (MD) yarns, further comprise a spun yarn wrapper.

8. An open-ended press fabric as claimed in claim 2, wherein said braided yarns, said braided yarns being said machine direction (MD) yarns, further comprise a monofilament yarn, said monofilament yarn being within said central core of said braided yarn.

UNITED STATES PATENT AND TRADEMARK OFFICE

CERTIFICATE OF CORRECTION

PATENT NO. : 5,005,610

DATED : April 9, 1991

INVENTOR(S) : Francis L. Davenport

It is certified that error appears in the above-identified patent and that said Letters Patent is hereby corrected as shown below:

9. An open-ended press fabric as claimed in claim 2, wherein said braided yarns, said braided yarns being said maching direction (MD) yarns, further comprise a plied monofilament yarn, said plied monofilament yarn being within said central core of said braided yarn.

Signed and Sealed this

Sixth Day of October, 1992

*Attest:*

DOUGLAS B. COMER

*Attesting Officer*

*Acting Commissioner of Patents and Trademarks*